US007735565B2

(12) United States Patent
Wells et al.

(10) Patent No.: US 7,735,565 B2
(45) Date of Patent: Jun. 15, 2010

(54) DUAL-SADDLE EAR SUPPORT APPARATUS

(75) Inventors: Lawrence E. Wells, Yorba Linda, CA (US); James Edward Lynch, Terrell, TX (US); Neil Edward West, Corona, CA (US); Guy L. McClung, III, Spring, TX (US)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 12/603,688

(22) Filed: Oct. 22, 2009

(65) Prior Publication Data

US 2010/0038095 A1 Feb. 18, 2010

Related U.S. Application Data

(63) Continuation of application No. 11/634,804, filed on Dec. 6, 2006, now abandoned.

(51) Int. Cl.
*E21B 19/18* (2006.01)
*E21B 19/00* (2006.01)

(52) U.S. Cl. ..... 166/379; 166/380; 166/77.52

(58) Field of Classification Search ..... 166/379, 166/380, 77.52; 294/91, 90, 86.11
See application file for complete search history.

(56) References Cited

U.S. PATENT DOCUMENTS

| | | | | |
|---|---|---|---|---|
| 1,021,984 | A | 4/1912 | Holmes | |
| 1,756,376 | A | 4/1930 | Moore | |
| 1,779,845 | A | 10/1930 | Harring | |
| 1,842,638 | A | 1/1932 | Wigle | |
| 3,461,666 | A | 8/1969 | Burstall | 59/35 |
| 3,777,046 | A | 12/1973 | Schiavone | 174/42 |
| 3,996,737 | A | 12/1976 | Burstall | 59/35 R |
| 4,421,447 | A | 12/1983 | Gudgel et al. | 414/22 |
| 4,449,596 | A | 5/1984 | Boyadjieff | 175/85 |
| 4,605,077 | A | 8/1986 | Boyadjieff | 175/85 |
| 4,753,300 | A | 6/1988 | Shaw et al. | 173/164 |
| 4,800,968 | A | 1/1989 | Shaw et al. | 175/85 |
| 5,529,316 | A | 6/1996 | Mattila | 280/95.1 |
| 5,906,450 | A | 5/1999 | Ng | 403/46 |
| 6,520,709 | B1 | 2/2003 | Mosing et al. | 403/305 |
| 6,725,938 | B1 | 4/2004 | Pietras | 166/380 |
| D523,210 | S | 6/2006 | Folk et al. | D34/35 |
| D523,451 | S | 6/2006 | Folk et al. | D15/138 |
| 7,303,021 | B2 * | 12/2007 | Schats et al. | 166/379 |
| 2006/0191690 | A1 * | 8/2006 | Severin et al. | 166/379 |

* cited by examiner

*Primary Examiner*—David J Bagnell
*Assistant Examiner*—Yong-Suk Ro
(74) *Attorney, Agent, or Firm*—Williams, Morgan & Amerson, P.C.

(57) ABSTRACT

An apparatus for use in wellbore operations and a method for using it is provided. The apparatus includes a main body, two support ears spaced-apart and projecting from the main body, each having an inner ear part and an outer ear part. The inner ear part is able to support more weight than the outer ear part. In certain aspects, structure for preventing a large support link from being positioned on an outer ear part is provided. The apparatus, may be any of a link adapter, a block adapter, a becket, an elevator, and a drilling hook.

28 Claims, 11 Drawing Sheets

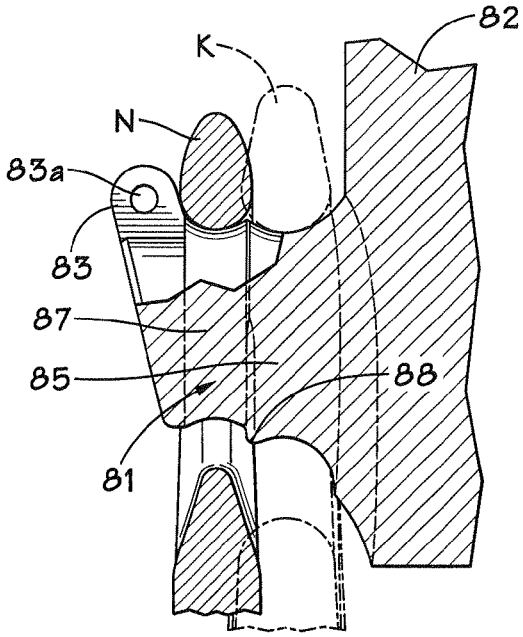
FIG. 4C
FIG. 4D
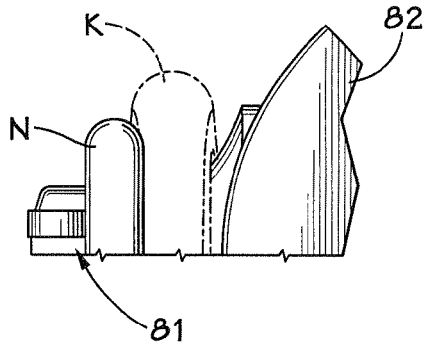
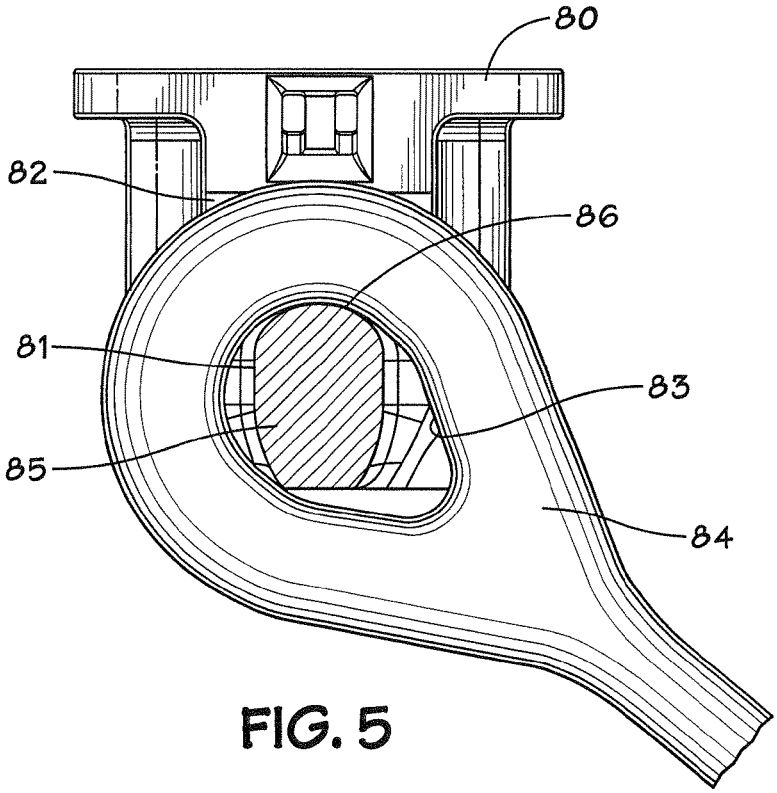
FIG. 5

FIG. 10
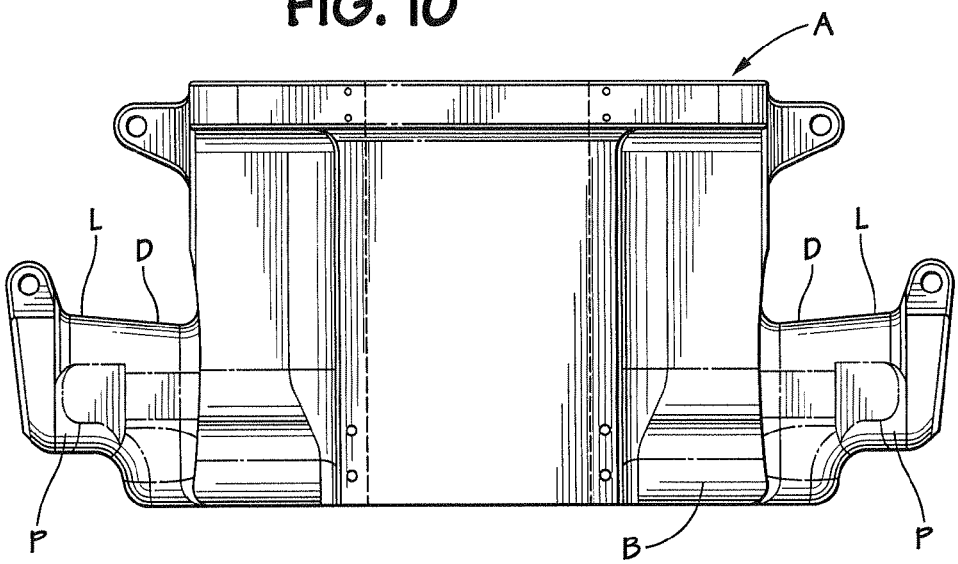
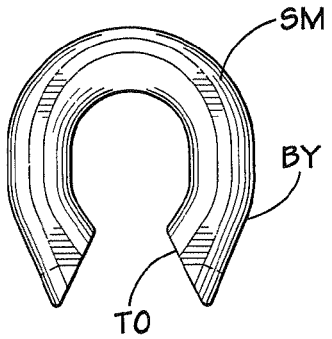
FIG. 10A
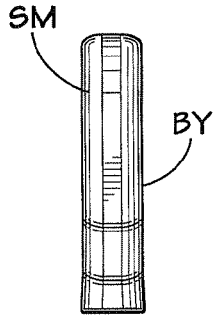
FIG. 10B
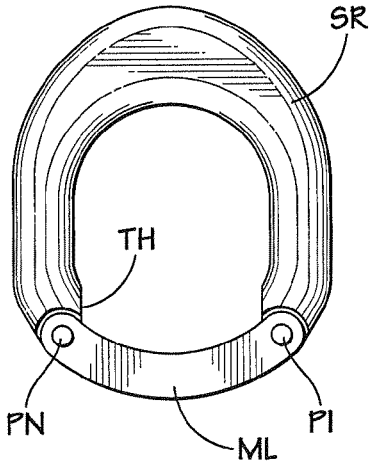
FIG. 10C
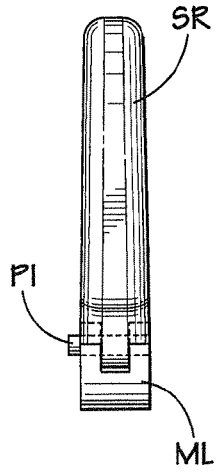
FIG. 10D

DUAL-SADDLE EAR SUPPORT APPARATUS

CROSS REFERENCE TO RELATED APPLICATIONS

This application is a continuation of U.S. patent application Ser. No. 11/634,804, filed on Dec. 6, 2006, now abandoned which is incorporated by reference herein for all it discloses.

BACKGROUND OF THE INVENTION

1. Field of the Invention

This invention is directed to support structures, to wellbore drilling apparatuses which have support ears projecting from a main body, and, in certain particular aspects, to link adapters, hooks, block adapters, beckets, and elevators with such ears.

2. Description of the Related Art

The prior art discloses a variety of apparatuses and items which have supports projecting out from a main body. In many instances these supports are referred to as "support ears" or "ears." The prior art also discloses a variety of support links which are used in conjunction with such supports. For example, and not by way of limitation, the following patents disclose structures with such supports and links used with them: U.S. Pat. Nos. 7,032,678; 6,725,938; 6,626,238; 6,494,273; 6,520,709; 6,073,699; 5,906,450; 5,755,289; 5,529,316; 4,605,077; 4,800,968; 4,753,300; 4,449,596; 4,421,447; 3,996,737; 3,777,046; 3,461,666; 1,842,638; 1,779,845; 1,756,376; 1,021,984; D 523,210; and D 523,451.

BRIEF SUMMARY OF THE INVENTION

The present invention, in certain aspects, provides an apparatus with opposed support ears projecting out from a main body of an apparatus useful in wellbore operations, each ear having dual adjacent areas or saddles around which an end eye of a support link is positionable. The saddle areas are of different dimensions for receiving links with end eye openings of different size. Thus, in certain aspects, a single ear can accommodate end eye openings of links which have a range of eye opening sizes; e.g. in certain aspects an inner saddle accommodates links with relatively larger end eye openings (in one aspect which can support relatively larger weights) and also an outer saddle that accommodates links with relatively smaller end eye openings (in one aspect which can support relatively smaller weights).

In certain aspects, in a dual saddle ear according to the present invention with two adjacent saddles, a first saddle and a second saddle, the first saddle is relatively larger than the second saddle so that it can support a larger weight than can the second saddle, the first saddle adjacent a main body of an apparatus from which the ears project, the second saddle spaced-apart from the main body by the first saddle. In certain aspects the larger links are prevented from placement on a smaller saddle.

In certain aspects, the two saddles of a dual saddle ear according to the present invention are configured and sized so that a relatively larger link for use with a first larger saddle area cannot be placed on a relatively smaller second saddle area. Also in certain aspects, an end eye opening of a relatively smaller link cannot fit around the relatively larger saddle. Grooves in the saddles, either completely around a saddle area or located only where they will receive part of a link, facilitate positioning of a link eye on a saddle; a saddle part that contacts a link, e.g. only a top of a saddle area has a groove.

In particular aspects, a relatively larger seat first saddle has a lip or projection which inhibits a link disposed in an adjacent relatively smaller second saddle from exiting the second saddle and moving into the first saddle so that correct positioning of the link is maintained e.g. during link movement in rotating on a saddle.

In certain aspects a movable member which selectively closes off a space adjacent an ear's saddles (e.g. a latch, catch link or retainer bar) is sized and shaped so that it will not close when a larger link is on a smaller saddle which is not sized for the larger link. In certain aspects the movable member encloses a portion of a link that is on a saddle of a dual saddle ear according to the present invention. The movable member provides for opening and closing an entry to the space adjacent the saddles of the dual saddle ear. In certain particular aspects the retainer bar is adjacent the outer saddle area of a dual saddle area ear. Such a retainer bar is of such a size and/or has structure thereon which prohibits a larger link from becoming positioned on the outer saddle area of a dual saddle area ear. Such a retainer bar will not close and shut when a larger link is on a smaller saddle area.

It is within the scope of the present invention for any ear disclosed herein according to the present invention to be used on any apparatus used in any wellbore operation which has dual spaced-apart support projections or ears, including, but not limited to, on link adapters, block adapters, elevators, and drilling hooks.

The present invention discloses, in certain aspects, an apparatus for use in wellbore operations, the apparatus having: a main body; two support ears spaced-apart and projecting from the main body, the ears for supporting two support links and an item connected to the support link, each ear having an inner ear part adjacent the main body and an outer ear part spaced-apart from the main body; each inner ear part having an inner support area; each outer ear part having an outer support area; the inner support area able to support a weight greater than can be supported by the outer support area; and each ear able to be used with a variety of support links of different end eye opening sizes. In such an apparatus each ear can have a top surface extending from the outer support area to the inner support area to the main body, each top surface inclined upwardly from the main body to the outer support area so that a link part on an ear tends to move down toward the main body. The apparatus can be, e.g., any of a link adapter, a block adapter, an elevator, a becket, and a drilling hook.

In such apparatuses wherein each support area can have a grooved portion for receipt therein of part of an end eye opening of a support link. Maintenance apparatuses (e.g. spacer members) can be used for maintaining a support link on a desired support area; and/or each ear can have latch apparatus movably connected thereto for selective releasable connection to the main body for closing off a space adjacent a corresponding ear.

Accordingly, the present invention includes new and non-obvious features and advantages. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some, but not all, of the objects of this invention. In addition to the specific objects stated below for at least certain preferred embodiments of the invention, there are other objects and purposes which will be readily apparent to one of skill in this art who has the benefit of this invention's teachings and disclosures.

It is, therefore, an object of at least certain preferred embodiments of the present invention to provide:

New, useful, unique, efficient, non-obvious dual-saddle ears for support structures, apparatuses with such ears, and methods of their use; such apparatuses including link adapters, block adapters, elevators, and hooks; and apparatuses useful in wellbore operations with such ears.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

FIG. 4C is a cross-section view of the ear of FIG. 4B.

FIG. 4D is a partial view of the ear of FIG. 4B.

FIG. 5 is a side view of a link adapter according to the present invention.

FIG. 10 is a front view of an apparatus according to the present invention.

FIG. 10A is a front view of a spacer according to the present invention.

FIG. 10B is a side view of a spacer of FIG. 10A.

FIG. 10C is a side view of a spacer of FIG. 10A.

FIG. 10D is a side view of a spacer of FIG. 10C.

Figure 2:
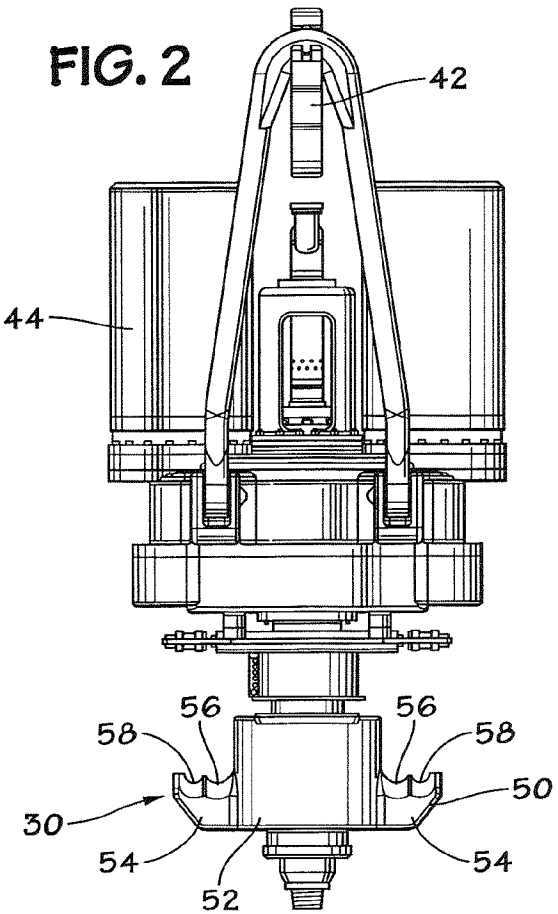
FIG. 2 is a front view that shows in detail part of the drilling system of FIG. 1 with a link adapter according to the present invention.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference.

DETAILED DESCRIPTION OF THE INVENTION

Figure 1:
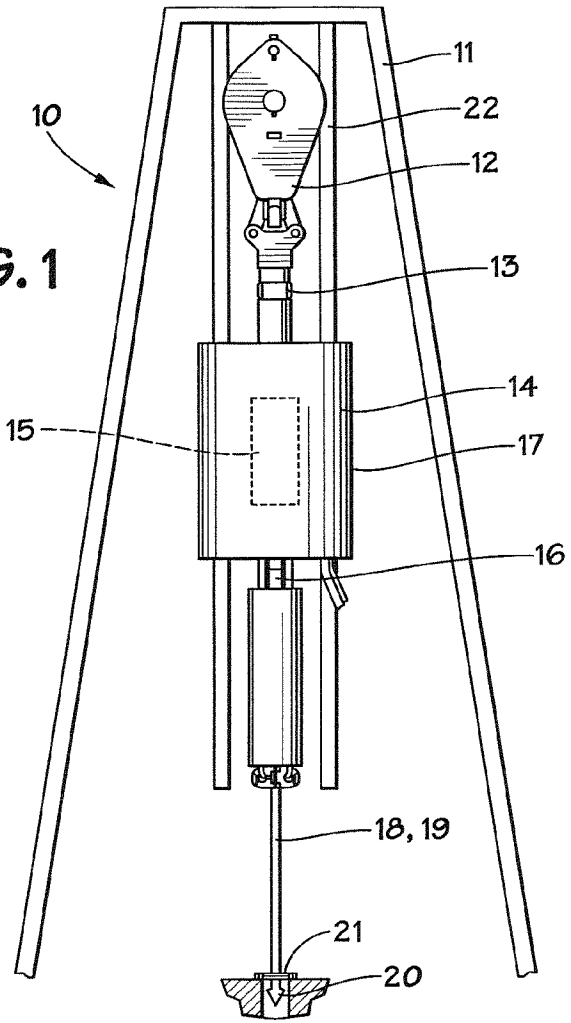
FIG. 1 shows schematically a drilling system according to the present invention.

FIG. 1 illustrates a system according to the present invention which is structurally supported by a derrick 11. The system 10 has a plurality of components including: a swivel 13, a top drive 14 with a block adapter and/or link adapter according to the present invention, a main shaft 16, a housing 17, a drill stem 18/drillstring 19 and a drill bit 20. The components are collectively suspended from a traveling block 12 that allows them to move upwardly and downwardly on rails 22 connected to the derrick 11 for guiding the vertical motion of the components. The main shaft 16 extends through the motor housing 17 and connects to the drill stem 18. The drill stem 18 is connected to one end of a series of tubular members collectively referred to as the drillstring 19. An opposite end of the drillstring 19 is connected to a drill bit 20 which produces an earth bore 21.

FIG. 2 illustrates a system 30 with a link adapter 50 according to the present invention. Suspended from a block adapter or becket 42 is a top drive system 44.

The link adapter 50 is connected to the top drive system 44. The link adapter 50 has a body 52 with opposed support ears 54 projecting from the body 52. Each ear 54 has an inner saddle 56 and an outer saddle 58. The inner saddles 56 are wider then the outer saddles 58.

Figure 3A:
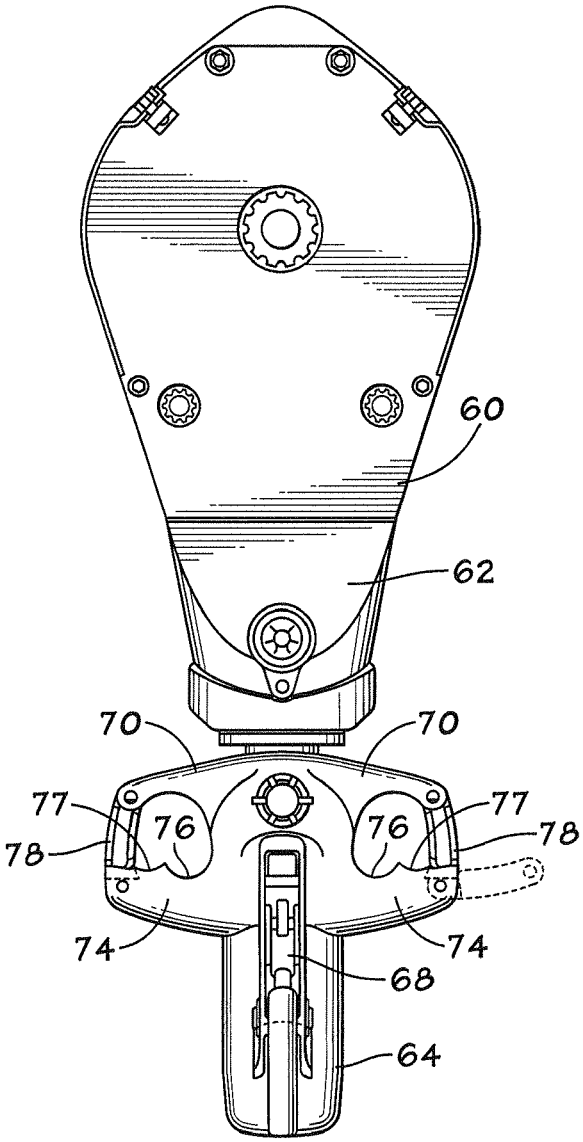
FIG. 3A is a front view showing a drilling hook according to the present invention.
Figure 3B:
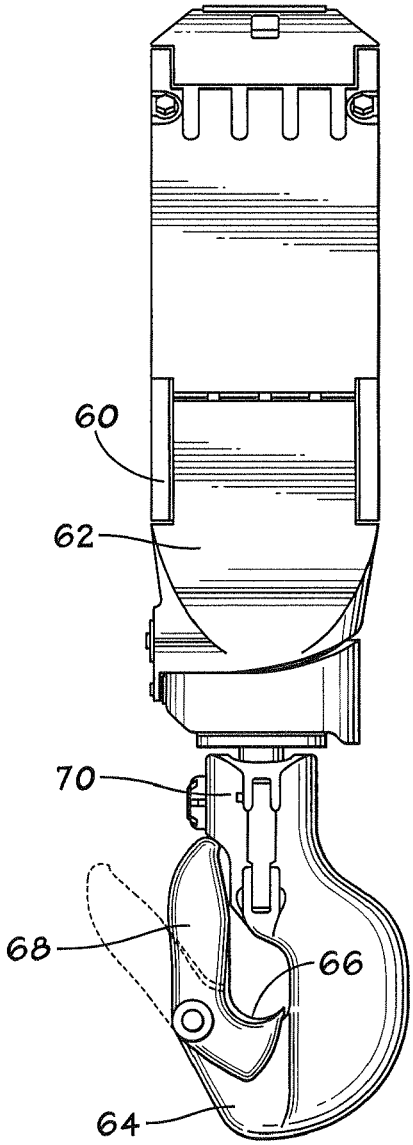
FIG. 3B is a side view of the drilling hook of FIG. 3A.
Figure 4A:
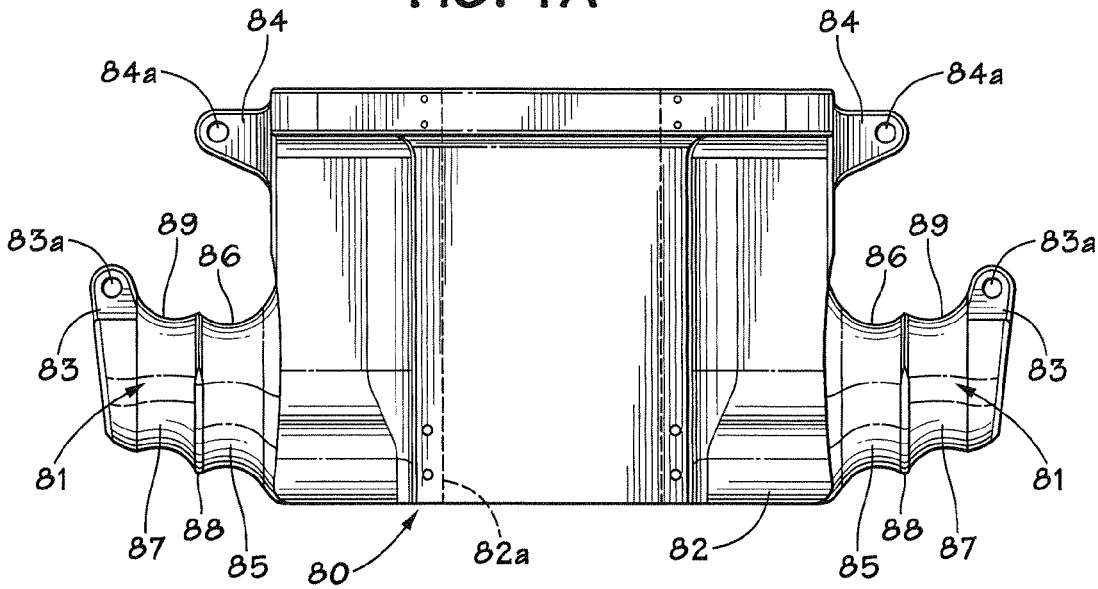
FIG. 4A is a front view of a link adapter according to the present invention.
Figure 4B:
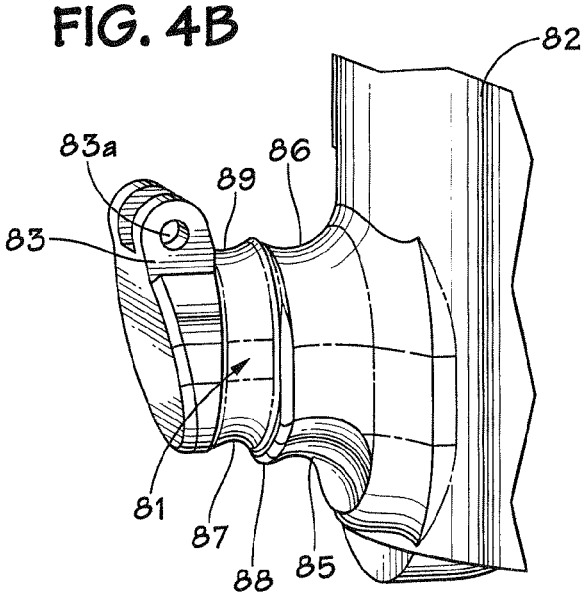
FIG. 4B is a perspective view of an ear of the link adapter of FIG. 4A.

FIGS. 3A and 3B illustrate a drilling hook 60 according to the present invention which has a body 62 to which is rotatably connected a hook member 64. The hook member 64 has a hook saddle 66 for receiving an item to be releasably connected to the hook 60 and a movable latch 68 which selectively closes off an entry path to the hook saddle 66 (see open latch illustrated in dotted lines, FIG. 3B). On the hook member 64 is a support 70 according to the present invention which has a body 72 with two spaced-apart support projections 74. Each support projection 74 has dual saddles 76, 77, with the saddles 76 larger than the saddles 77. Movable latch members 78 (also called retainer bars or catch links) selectively close off entry pathways for the eyes of support links to be placed on one or the other of the saddles (dotted lines, FIG. 3A, show a latch member 78 open).

FIGS. 4A-4D show a link adapter 80 with dual opposed ears 81 projecting from a body 82. Each ear 81 has an inner ear part 85 with an inner saddle 86 and an outer ear part 87 with an outer saddle 89. A bore 82*a* goes through the adapter 80 and it has portions 83 with holes 83*a* for attachment to another item (e.g. a retainer bar or latch). The inner ear part is larger and more massive than the outer ear part.

As shown in FIG. 4C a relatively larger link K has an eye that can rest in an inner saddle 86, but it cannot rest in an outer saddle 89. A link N can rest in either saddle (shown in an outer saddle 89). Top projections 84 have attachment holes 84*a*. An optional lip or ridge 88 (shown in FIGS. 4B, 4C) helps to maintain part of a link on a desired saddle, e.g. the ridge 88 can inhibit or prevent a smaller link from moving from an outer saddle 89 to an inner saddle 86, or a larger link from moving from an inner saddle to an outer saddle.

Figure 6:
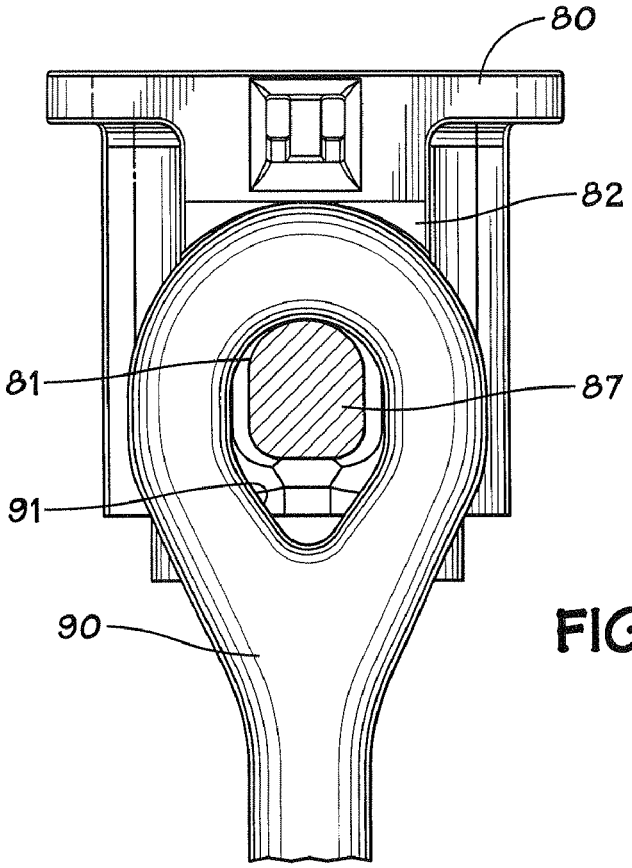
FIG. 6 is a side view of a link adapter according to the present invention.
Figure 7:
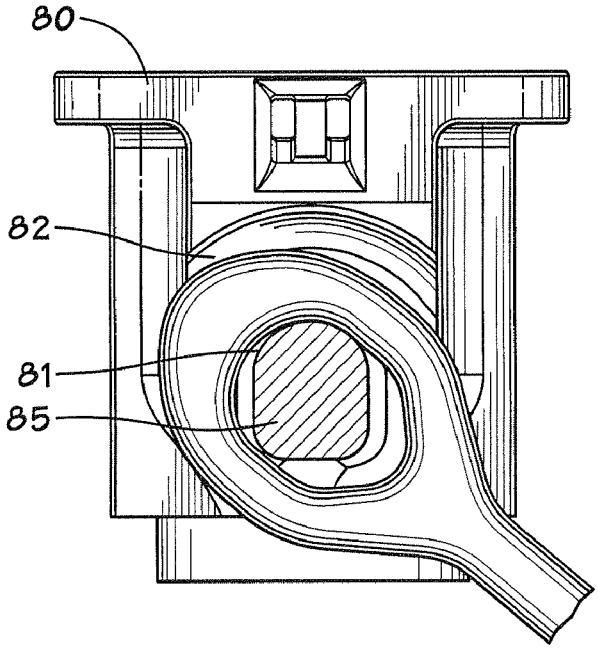
FIG. 7 is a side view of a link adapter according to the present invention.

FIGS. 5-7 show the link adapter 80 according to the present invention supporting various support links. As shown in FIG. 5 an eye 83 of a 1250 ton link 84 is supported by an inner part 85 of an ear 81 with the eye of the link in an inner saddle 86 of the ear 81. In certain aspects, inner ear parts of an apparatus according to the present invention can support at least 1250 tons.

FIG. 6 shows an eye 91 of a 750 ton link 90 supported by an outer part 82 of an ear 81.

FIG. 7 shows an eye 92 of a 500 ton link 94 supported by an outer part 85 of an ear 81. Neither the link 90 nor the link 94 can move onto the inner part.

Figure 8:
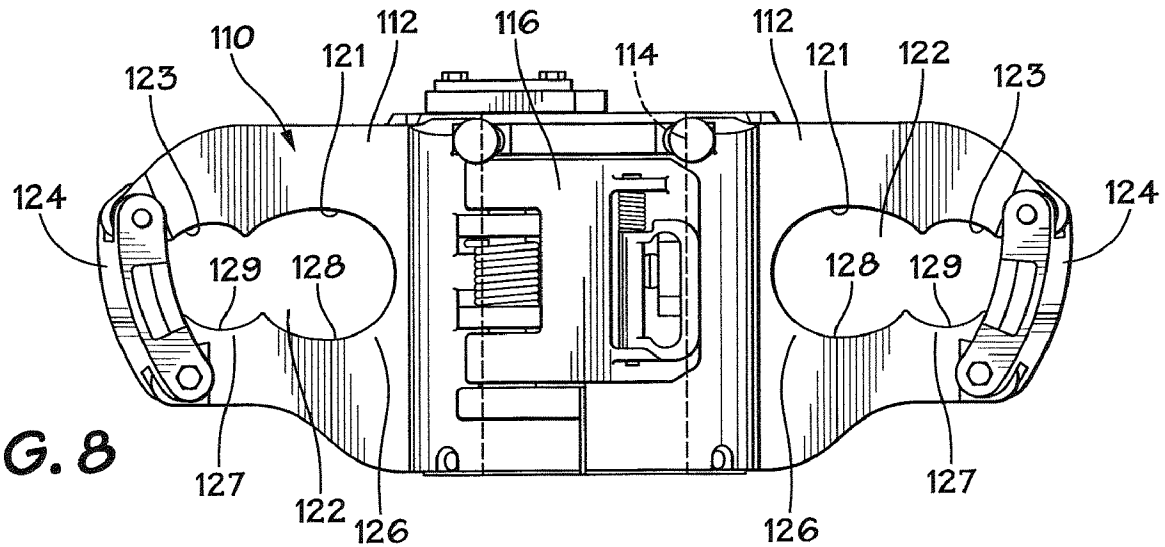
FIG. 8 is a front view of an apparatus according to the present invention.

FIG. 8 shows an elevator 110 with a body 112 having a bore 114 therethrough. A latch apparatus 116 selectively provides opening for an entry passage for tubulars. Two opposed supports 120 project out from the body 112. Each support 120 has a space 122 selectively closed off by movable latches 124. Each support 120 has a first inner part 126 with an inner saddle 128 and a second outer part 127 with an outer saddle 129. The inner saddles 128 are larger than the outer saddles 129, as are the first inner parts compared to the second outer parts. Optionally each support 120 has an upper inner saddle 121 and an upper outer saddle 123. Any structure herein according to the present invention for preventing a larger link from being placed on a smaller saddle may be used with the elevator 110 or with an apparatus A, FIG. 10.

Figure 9C:
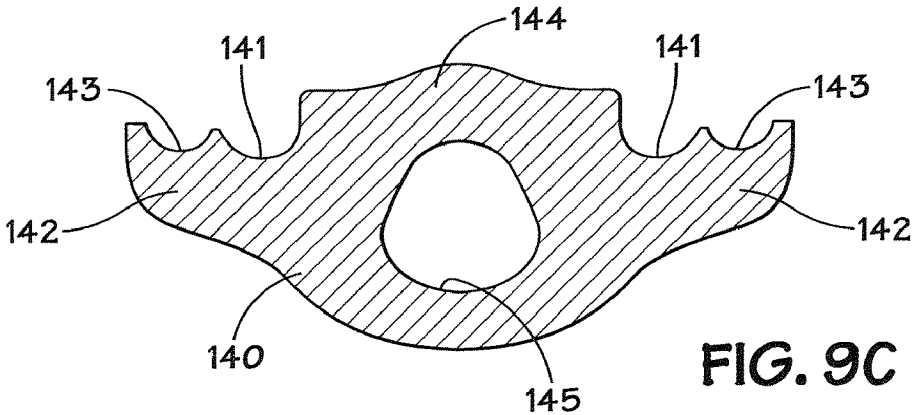
FIG. 9C is a cross-section view of the block adapter of FIG. 9A.
Figure 9B:
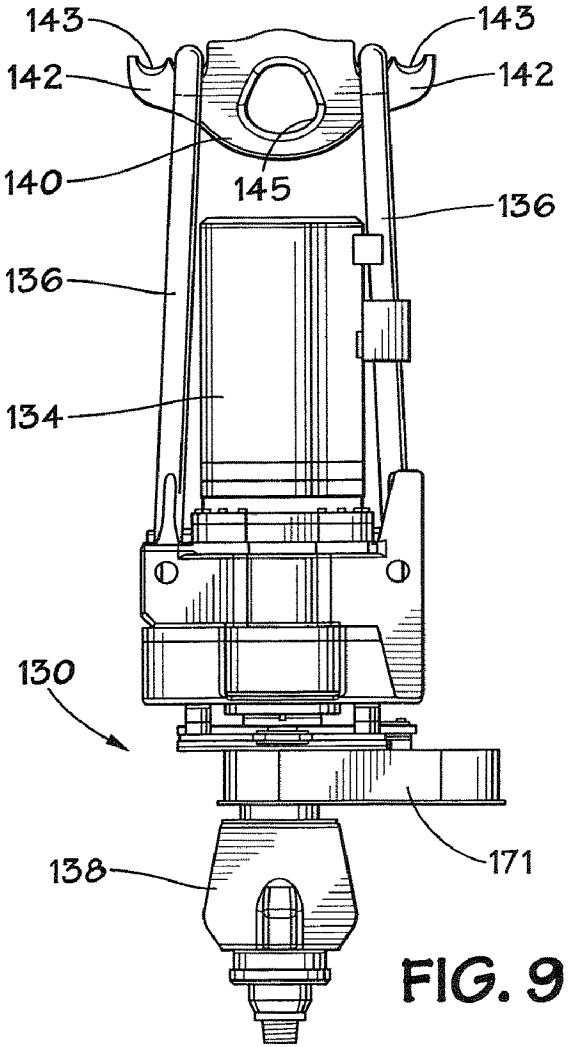
FIG. 9B is a front view of the apparatus of FIG. 9A.
Figure 9A:
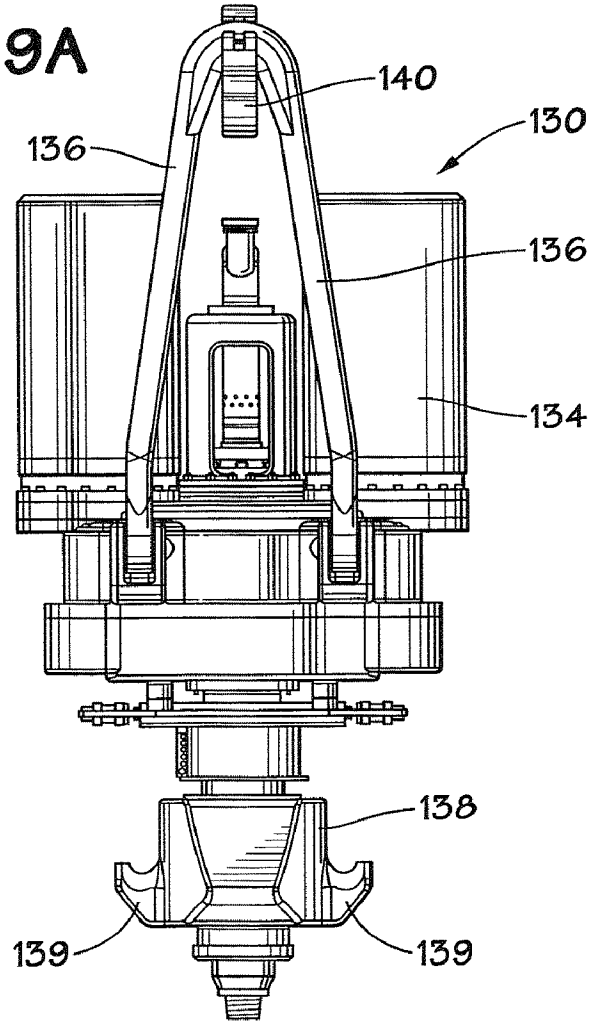
FIG. 9A is a side view of a top drive apparatus with a block adapter according to the present invention.

FIGS. 9A and 9B show a system 130 according to the present invention with a top drive system 134 suspended by links 136 from a block adapter (or "becket") 140. An eye of each link 136 is in an inner saddle 141 of an ear 142 of the adapter 140. Each ear 142 also has an outer saddle 143. Optionally a body 144 of the adapter 140 has a cutout portion 145 to reduce weight. A link adapter 138 of the system 134 is shown with single saddle ears 139; but any dual saddle ear according to the present invention may be used instead of the single saddle ears 139.

FIG. 10 illustrates the applicability of two ears with dual saddles to any suitable wellbore operations apparatus A shown schematically in FIG. 10. The apparatus A has a body B from which extend opposed support projections P (or ears) each with dual saddle areas D and L. The saddle areas may be any saddle area according to the present invention with or without grooves. Optionally (or instead of the dual opposed lower ears as shown), the apparatus A may have dual opposed upper ears according to the present invention (any disclosed herein).

FIG. 10 illustrates the applicability of two ears with dual support areas to any suitable wellbore operations apparatus A shown schematically in FIG. 10. The apparatus A has a body B from which extend opposed support projections P each with dual support areas D and L. The areas D and L may be any saddle or area according to the present invention. The apparatus A may have any latch or latches disclosed herein. The support projections P may have any groove or grooves disclosed herein. The mass of the areas D is such that the areas D will support a greater weight than the areas L which are of less mass than the areas D. The areas D have a greater cross-sectional area than the cross-sectional area of the areas L; thus a support link with an eye end opening sufficient large to fit around and encompass an area D will also fit over an area L; but a support link with an end eye opening not large enough to encompass an area D will not be moveable around an area D and B, therefore prevented from being placed around an area D, while such an end eye opening is of sufficient size to fit around an area L. The top surfaces of the areas D and L may be substantially horizontal; or, as shown, these surfaces may be inclined upwardly from the body B to an outer extremity of each projection P. This inclined surface, of sufficient inclination, insures that a relatively larger support link is moved by gravity down the inclined surface so that a relatively larger link will not remain in position on a support area L; thus insuring that a relatively larger load suspended from relatively larger support links is not imposed on the smaller support areas L. In certain particular aspects the support areas D are sized to support at least twice as much weight as the support areas L. In one particular aspect the support areas L are sized to support up to 500 tons or up to 750 tons while the support areas D are sized to support at least 1000 tons and in one aspect up to 1250 tons. The over all shape and the cross-sectional shape of the support areas D and L may be the shape of any known support ear or support projection or any shape disclosed herein.

Figure 11A:
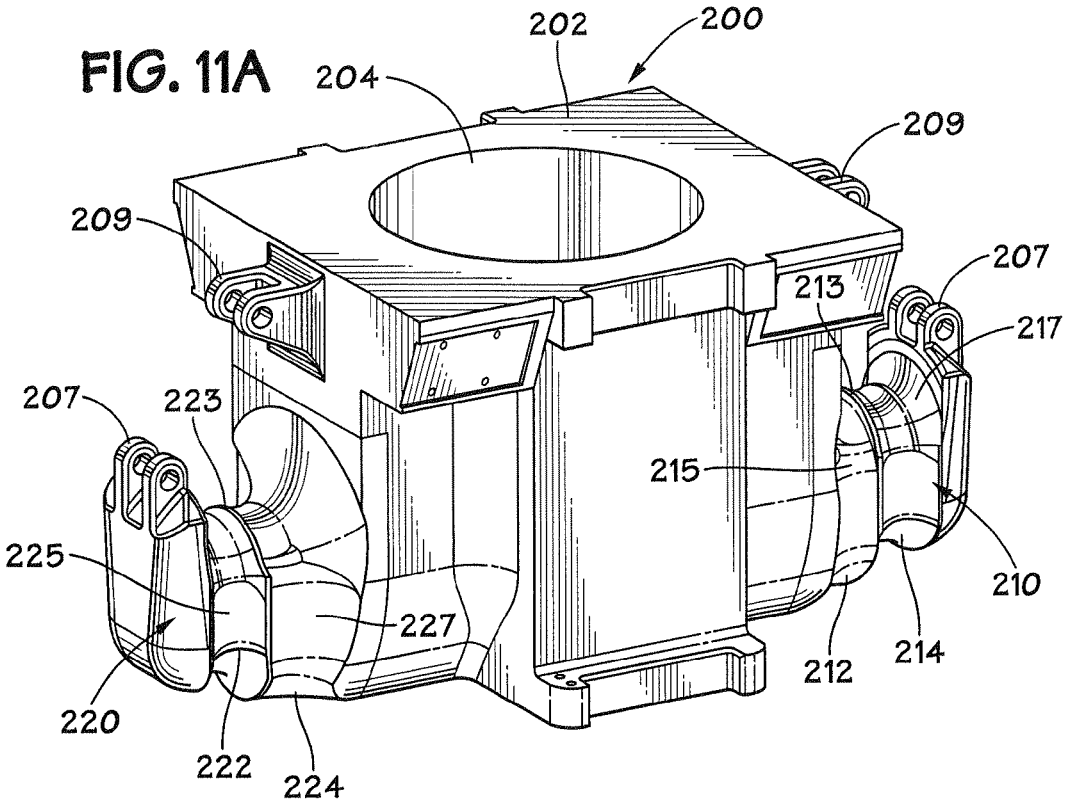
FIG. 11A is a perspective view of a link adapter according to the present invention.
Figure 11B:
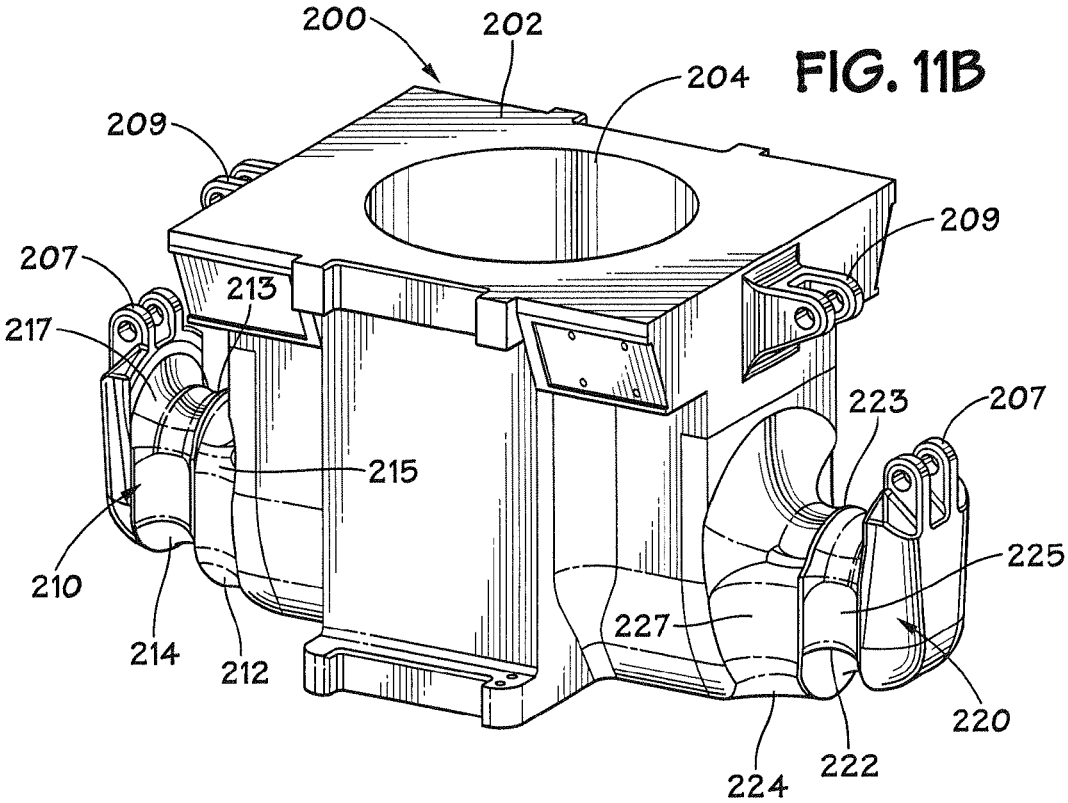
FIG. 11B is a perspective view of a link adapter of FIG. 11A.
Figure 11C:
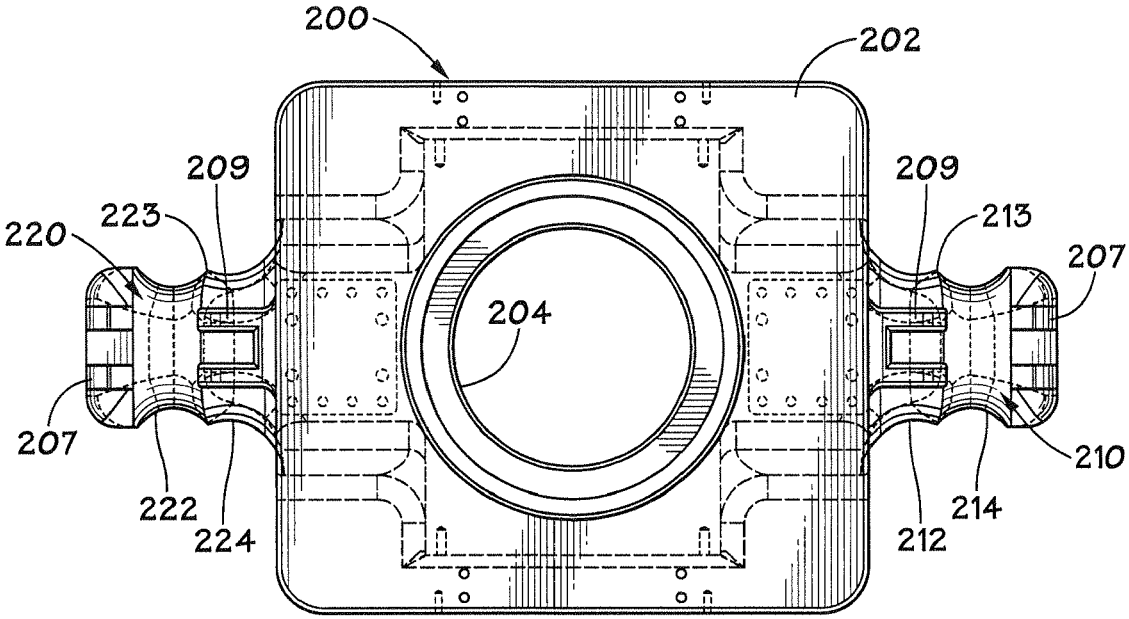
FIG. 11C is a top view of a link adapter of FIG. 11A.
Figure 11D:
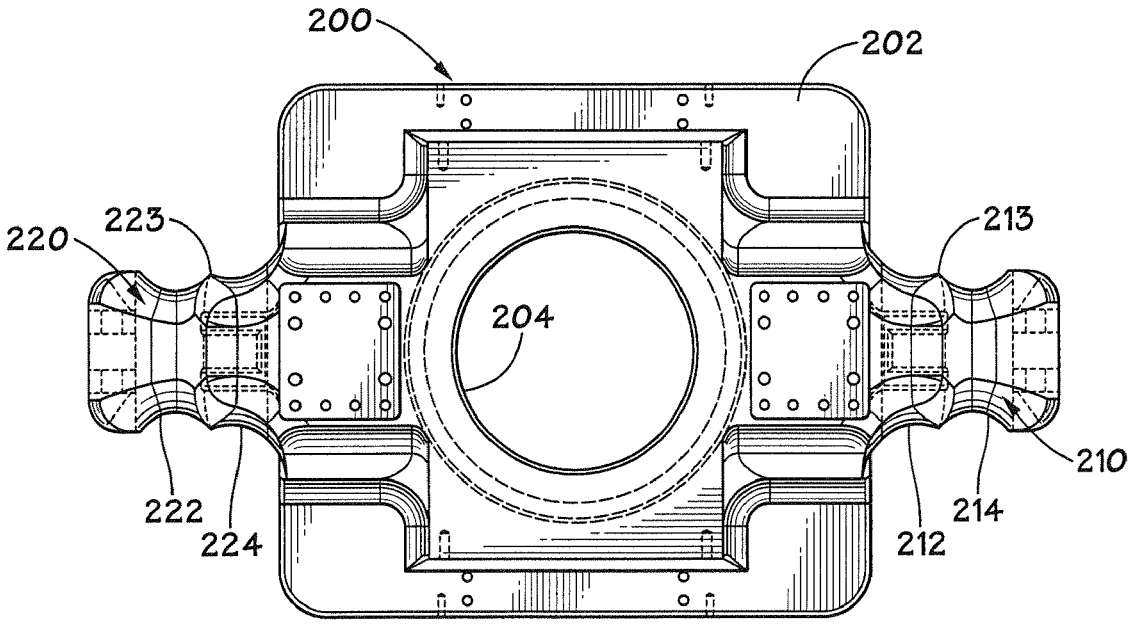
FIG. 11D is a bottom view of a link adapter of FIG. 11A.
Figure 11E:
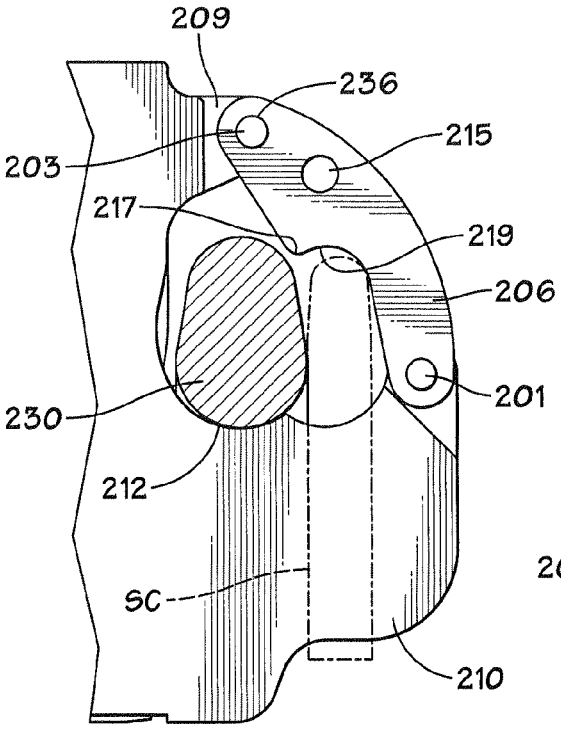
FIG. 11E is a partial front view of part of the link adapter of FIG. 11A.
Figure 11F:
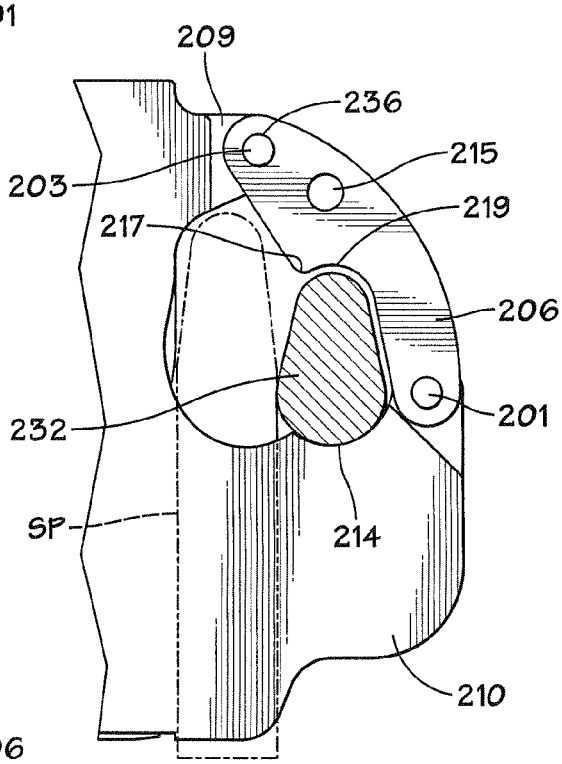
FIG. 11F is a partial front view of part of the link adapter of FIG. 11A.

In any embodiment of the present invention a spacer member may be used on either an inner support area (or inner saddle) or on an outer support area (or outer saddle) to occupy the space above the area (or saddle) to prevent an eye part of a support link from occupying the chosen area (see, e.g. FIGS. 11E, 11F). The size of the spacer member is chosen to occupy a chosen amount of the space above a support area or saddle so that a support link eye is positioned as desired on the support area or saddle. In one aspect using such a spacer member on ears or projections as in FIG. 10 insures that a support link with an eye opening to be positioned in a support area L can be so positioned and maintained in place so that the link can pivot as desired about the support area L without moving down so far on a projection p that the link binds on the projection P and cannot move as desired. In other aspects a spacer member is releasably emplaced on an outer support area or saddle so that a relatively larger link is maintained in positioned on an inner support area or saddle.

FIGS. 10A and 10B show a spacer member SM according to the present invention which has a body BY and a throat opening TO. The throat opening TO is placed adjacent a support area or saddle of an ear or projection and then the spacer member SM is moved onto the ear or projection and is held in place there by gravity.

Optionally, a throat opening of a spacer member according to the present invention may have a movable closure or latch so that once a spacer member is in place on a support area or saddle, the latch or closure is closed so that the spacer member cannot fall off. Any suitable latch or closure member may be used. In one aspect a spacer member SR, FIGS. 10C and 10D, has a throat opening TH and a movable latch ML pivotably pinned at one end to the spacer member SR with a pin PN and releasably held to the opposite end of the spacer member SR with a removable pin PI. A spacer member or members, any according to the present invention, may be used with any apparatus according to the present invention; e.g., but not limited to, those of FIGS. 2-11G. A spacer member or members may be used to insure that each of two links is maintained in position either both on inner support areas or saddles or both on outer support areas or saddles—e.g. to insure that whatever is supported by support links is maintained in balance; or to insure that a single link is maintained on a desired support area or saddle.

FIGS. 11A-11G show a link adapter 200 according to the present invention with dual saddle ears 210, 220 according to the present invention. The ears 210, 220 may be used on any wellbore operations device or apparatus which supports or is supported by links.

The link adapter 200 has a body 202 with a central bore 204 therethrough from top to bottom. Latches 206 pivotably connected to latch holders 207 of the ears are releasably connectable to latch holders 209 on the body to selectively enclose eyes of links supported by the ears 210, 220.

The ear 210 has dual saddles 212, 214 and the ear 220 has dual saddles 222, 224. A ridge 213 is formed between the saddles 212, 214 with the ridge 213 rising up from grooves 215, 217 in the saddles 212, 214, respectively. A ridge 223 is formed between the saddles 222, 224 with the ridge 223 rising up from grooves 225, 227 in the saddles 222, 224, respectively. As with any ridge between saddles or support areas, the ridges 213, 223 help to maintain part of a link on a desired saddle or support area.

FIG. 11E shows part of an eye of a link 230 in the saddle 212 with the latch 206 closed. The latch 206 pivots on a pin 201 and is held to the latch holders 209 with a removable pin 203. A hole 215 facilitates movement of the latch 206. A projection 217 of the latch 206 does not contact the link 230.

FIG. 11F shows part of an eye of a link 232 on the saddle 214 with the latch 206 closed. A recess 219 in the latch 206 accommodates the top of the link 232.

Figure 11G:
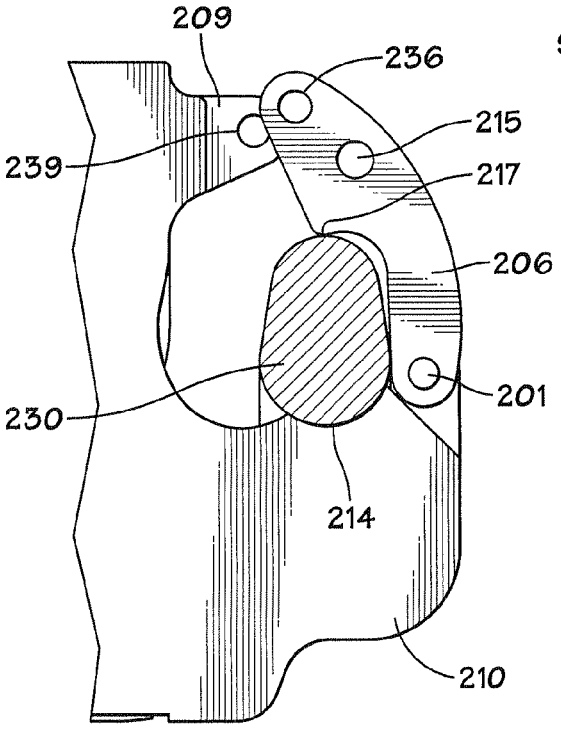
FIG. 11G is a partial front view of part of the link adapter of FIG. 11A.

As shown in FIG. 11G, with the link 230 on the saddle 214, the projection 217 of the latch 206 contacts the top of the link 230 and prevents the latch 206 from closing (the pin 203 cannot be inserted through holes 236 in the latch 206 and into the holes 239 of the latch holders 209). A latch or latches 206 may be used on any apparatus according to the present invention and on any embodiment in any of the drawing figures.

As shown in FIG. 11F with or instead of a latch 206 with a projection 217, a spacer member SP (shown in dotted lines) may be used, releasably installed on the saddle 212 to prevent the link 232 from moving onto the saddle 212. Also as illustrated by the spacer member SC (shown in dotted lines, FIG. 11E) may be used with or instead of the latch 206 to prevent the link 230 from moving onto the saddle 214.

The present invention, therefore, provides in some, but not in necessarily all, embodiments an apparatus for use in wellbore operations, the apparatus including: a main body; two ears spaced-apart and projecting from the main body, each of said ears for supporting a support link and an item connected to the support link, each ear having an inner ear part adjacent the main body and an outer ear part spaced-apart from the main body; each inner ear part having an inner support area; each outer ear part having an outer support area; and the inner support area able to support a weight greater than can be supported by the outer support area. Such a system may have one or some, in any possible combination, of the following: each ear having a top surface extending from the outer support area to the inner support area to the main body, each top surface inclined upwardly from the main body to the outer support area so that a link part on an ear tends to move down toward the main body; wherein the apparatus is any of a link adapter, a block adapter, an elevator, a becket, and a drilling hook; wherein each support area has a grooved portion for receipt therein of part of an end eye opening of a support link; maintenance apparatus for maintaining a support link on a support area; each ear having latch apparatus movably connected thereto for selective releasable connection to the main body for closing off a space adjacent a corresponding ear; each latch apparatus including a body and a projection projecting from the body for abutment with a large link, said abutment preventing closure of the latch apparatus if part of the large link is on an outer support area; a ridge between the inner ear part and the outer ear part, the ridge inhibiting movement of a link end eye opening over the ridge; wherein the apparatus is a link adapter, and wherein the main body is a link adapter body, the link adapter body has a top and a bottom, the link adapter body has a central bore therethrough from top to bottom, and each inner ear part larger than each outer ear part; wherein each inner support area part can support at least 1250 tons; wherein each inner support area can support at least 1000 tons, and each outer support area can support up to 500 tons or up to 750 tons; each inner support area can support at least twice as much weight as each outer support area; and/or wherein each ear can be used with links with different end eye opening sizes.

The present invention, therefore, provides in some, but not in necessarily all, embodiments a method for supporting an item useful in wellbore operations, the method including connecting the items to a support apparatus with support links, suspending the item below the support apparatus using the support links, the support apparatus having: a main body, two ears spaced-apart and projecting from the main body, each of said ears for supporting one of the support links and the item connected to the support links, each ear having an inner ear part and an outer ear part, each inner ear part having an inner support area, each outer ear part having an outer support area, and the inner support area able to support a weight greater than can be supported by the outer support area. Such a system may have one or some, in any possible combination, of the following: each support link having a top end eye opening, each top end eye opening on an inner part of one of the two ears, the method further including preventing each top end eye opening from moving onto an outer ear part; maintaining with maintenance apparatus the support links in place with respect to the inner ear parts and the outer ear parts; wherein the support apparatus includes each ear having latch apparatus movably connected thereto for selective releasable connection to the main body for closing off a space adjacent a corresponding ear and the method further including closing each latch apparatus with each top end eye opening on an inner ear part; wherein each latch apparatus has a projection for abutment against a link part with the top end eye opening, said abutment prohibiting closure of the latch apparatus if the link part is on the outer part of an ear; and/or wherein each inner support area can support at least 1250 tons and each outer support area can support up to 500 tons or up to 750 tons.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps.

Whereas the present invention has been described in particular relation to the drawings attached hereto, it should be understood that other and further modifications apart from those shown or suggested herein, may be made within the scope and spirit of the present invention.

What is claimed is:

1. An apparatus for use in wellbore operations, the apparatus comprising:

a main body; and two ears spaced-apart and projecting from the main body, the two ears for supporting support links and items connected to the support links, each of the two ears having an inner ear part and an outer ear part, the inner ear part adjacent the main body, the outer ear part adjacent the inner ear part and spaced-apart from the main body;

wherein each inner ear part and each outer ear part is for receiving support links, the inner ear part being larger than the outer ear part for receiving a larger support link than can be received by the outer ear part whereby each of the two ears are usable with a variety of support links having different sizes.

2. The apparatus of claim 1, wherein the inner ear part is able to support a weight greater than can be supported by the outer ear part.

3. The apparatus of claim 1, wherein each of the support links has an end eye opening therethrough, wherein the outer ear part is sized to accommodate support links with an end eye opening too small to be positioned on the inner ear part.

4. The apparatus of claim 1, where in the inner ear part has an inner saddle-shaped groove and the outer ear part has an outer saddle-shaped groove, the inner saddle-shaped groove sized to receive support links having a larger size than can be received by the outer saddle-shaped groove.

5. The apparatus of claim 1, wherein each of the two spaced-apart ears has a ridge between the inner ear part and the outer ear part, the ridge inhibiting movement of support links over the ridge.

6. The apparatus of claim 1, further comprising a latch movably connected to each of the two spaced-apart ears for selective releasable connection to the main body, the latch selectively closing off a space adjacent thereto.

7. The apparatus of claim 6, wherein each latch comprises a body and a projection projecting from the body, the projection preventing the latch from closing if a large support link is positioned in the outer ear part.

8. The apparatus of claim 7, wherein the latch, when closed, prevents support links from moving between the inner and outer ear parts.

9. The apparatus of claim 1, further comprising maintenance apparatus for maintaining support links on a support area of one of the inner ear part and the outer ear part, the maintenance apparatus having a body with an open throat for receiving part of one of the two ears.

10. The apparatus of claim 9, wherein the maintenance apparatus comprises a latch pivotally pinned to an end of the maintenance apparatus for closing off a space adjacent thereto.

11. The apparatus of claim 1, wherein the apparatus is one of a link adapter, a block adapter, an elevator, a becket and a drilling hook.

12. The apparatus of claim 1, wherein the apparatus is a link adapter, the main body comprising a support link adapter body having a top and a bottom with a central bore therethrough extending from the top to the bottom.

13. A system useful in a wellbore operation, comprising:

a derrick;

an apparatus comprising:

a main body; and two ears spaced-apart and projecting from the main body, the two ears for supporting support links and items connected to the support links, each of the two ears having an inner ear part and an outer ear part, the inner ear part adjacent the main body, the outer ear part adjacent the inner ear part and spaced-apart from the main body;

wherein each inner ear part and each outer ear part is for receiving support links, the inner ear part being larger than the outer ear part for receiving a larger support link than can be received by the outer ear part whereby each of the two ears are usable with a variety of support links having different sizes.

14. The system of claim 13, wherein the derrick comprises a top drive with a traveling block movable upwardly and downwardly in the derrick, the apparatus operatively connected to the traveling block.

15. The system of claim 13, wherein the apparatus is one of a link adapter, a block adapter, an elevator, a becket and a drilling hook.

16. The system of claim 13, wherein the inner ear part is able to support a weight greater than can be supported by the outer ear part.

17. The system of claim 13, wherein each of the support links has an end eye opening therethrough, wherein the outer ear part is sized to accommodate support links with an end eye opening too small to be positioned on the inner ear part.

18. The system of claim 13, where in the inner ear part has an inner saddle-shaped groove and the outer ear part has an outer saddle-shaped groove, the inner saddle-shaped groove sized to receive support links having a larger size than can be received by the outer saddle-shaped groove.

19. The system of claim 13, further comprising maintenance apparatus for maintaining support links on a support area of one of the inner ear part and the outer ear part, the maintenance apparatus having a body with an open throat for receiving part of one of the two ears.

20. A method for performing a wellbore operation, comprising:

providing an apparatus, comprising:

a main body; and two ears spaced-apart and projecting from the main body, the two ears for supporting support links and items connected to the support links, each of the two ears having an inner ear part and an outer ear part, the inner ear part adjacent the main body, the outer ear part adjacent the inner ear part and spaced-apart from the main body;

wherein each inner ear part and each outer ear part is for receiving support links, the inner ear part being larger than the outer ear part for receiving support links that are too large to be received by the inner ear part whereby each of the two ears are usable with a variety of support links having different sizes;

positioning at least one support link on at least one of the two ears such that the at least one support links that are too large for the outer ear part are placed on the inner ear part; and connecting at least one item to the at least one support links.

21. The method of claim 20, further comprising connecting the apparatus to a derrick above a wellbore site.

22. The method of claim 20, wherein the inner ear part apparatus is able to support a weight greater than can be supported by the outer ear part and wherein the step of positioning comprises positioning at least one support link on at least one of the two ears such that the at least one support links and at least one items that are too heavy to be supported by the outer ear part are positioned on the inner ear part.

23. The method of claim 20, wherein each of the support links has an end eye opening therethrough, wherein the outer ear part is sized to accommodate support links with an end eye opening too small to be positioned on the inner ear part, and wherein the step of positioning comprises positioning at least one support link on one of the two ears such that the at least one support links with an end eye opening that is too small for the inner ear part are positioned on the outer ear part.

24. The method of claim 20, wherein the inner ear part has an inner saddle-shaped groove and the outer ear part has an outer saddle-shaped groove for receiving one of the support links, the inner saddle-shaped groove sized to receive the support links having a larger size than can be received by the outer saddle-shaped groove, and wherein the step of positioning comprises positioning at least one support link on at least one of the two ears such that the at least one support links having a larger size than can be received by the outer saddle-shaped groove are positioned on the inner ear part.

25. The method of claim 20, further comprising after the step of positioning, preventing the at least one support link from moving from between the inner ear part and the outer ear part.

26. The method of claim 20, further comprising after the step of positioning, maintaining with a maintenance apparatus the at least one support link in place on one of the inner and outer ear parts.

27. The method of claim 20, wherein each of the two spaced-apart ears has a ridge between the inner ear part and the outer ear part, and wherein the method further comprises after the step of positioning, inhibiting movement of the at least one support link over the ridge.

28. The method of claim 20, wherein the apparatus further comprises a latch movably connected to each of the two spaced-apart ears for selective releasable connection to the main body, the latch selectively closing off a space adjacent thereto, and wherein the method further comprises after the step of positioning, selectively closing off the space with the latch.

* * * * *